US007229109B2

(12) United States Patent
Leibovitz

(10) Patent No.: US 7,229,109 B2
(45) Date of Patent: Jun. 12, 2007

(54) HOIST FOR CONSTRUCTION MATERIAL

(76) Inventor: Eitan Leibovitz, 18 Hashalom St., Even Yehuda (IL) 40500

( * ) Notice: Subject to any disclaimer, the term of this patent is extended or adjusted under 35 U.S.C. 154(b) by 0 days.

(21) Appl. No.: 10/549,861

(22) PCT Filed: Jan. 28, 2004

(86) PCT No.: PCT/IL2004/000082

§ 371 (c)(1),
(2), (4) Date: Sep. 22, 2005

(87) PCT Pub. No.: WO2004/069727

PCT Pub. Date: Aug. 19, 2004

(65) Prior Publication Data

US 2006/0249966 A1 Nov. 9, 2006

(51) Int. Cl.
*B66C 13/08* (2006.01)

(52) U.S. Cl. ..... 294/67.5; 294/67.1; 294/67.2

(58) Field of Classification Search ..... 294/67.1, 294/67.2, 67.21, 67.22, 67.3, 67.5, 81.56
See application file for complete search history.

(56) References Cited

U.S. PATENT DOCUMENTS 1,591,248 A * 7/1926 Tracy ..... 294/67.5
2,851,170 A * 9/1958 McDonough ..... 414/10
3,521,924 A * 7/1970 Wallenius ..... 294/67.1
3,879,077 A * 4/1975 Celio ..... 294/67.1
3,998,488 A * 12/1976 Durgan ..... 294/67.21
4,286,817 A * 9/1981 Moritz ..... 294/67.21
4,950,012 A * 8/1990 Jones ..... 294/67.2
5,431,470 A * 7/1995 Magerl et al. ..... 294/67.2

* cited by examiner

*Primary Examiner*—Dean J. Kramer

(57) ABSTRACT

A hoist for construction sites, for carrying loads suspended from a crane. The hoist is C shaped, suspended at its top arm by a cable of a crane. The bottom arm carries a hook, typically vertically movable, for lifting and moving loads about in the construction site. Owing to its lateral opening, the hoist can deliver loads into the interior space of floors, using minimal crew and relying mainly on the crane for maneuverability.

4 Claims, 7 Drawing Sheets

HOIST FOR CONSTRUCTION MATERIAL

FIELD OF THE INVENTION

The present invention relates generally to auxiliary equipment used in the construction industry. More particularly, the invention relates to hoisting of building material in construction sites.

BACKGROUND OF THE INVENTION

Relocation of building material and associated tools constitutes a substantial effort on behalf of a construction team in a construction site. Transferring of building material from unloading locations to sites of consumption, is a mechanized task, often employing cranes and various other mechanical instruments. The present invention provides means for minimizing costs, reducing manpower, increasing speed and simplifying the labour involved in relocation within the framework of a construction project.

DESCRIPTION OF THE PRESENT INVENTION

Figure 1A:
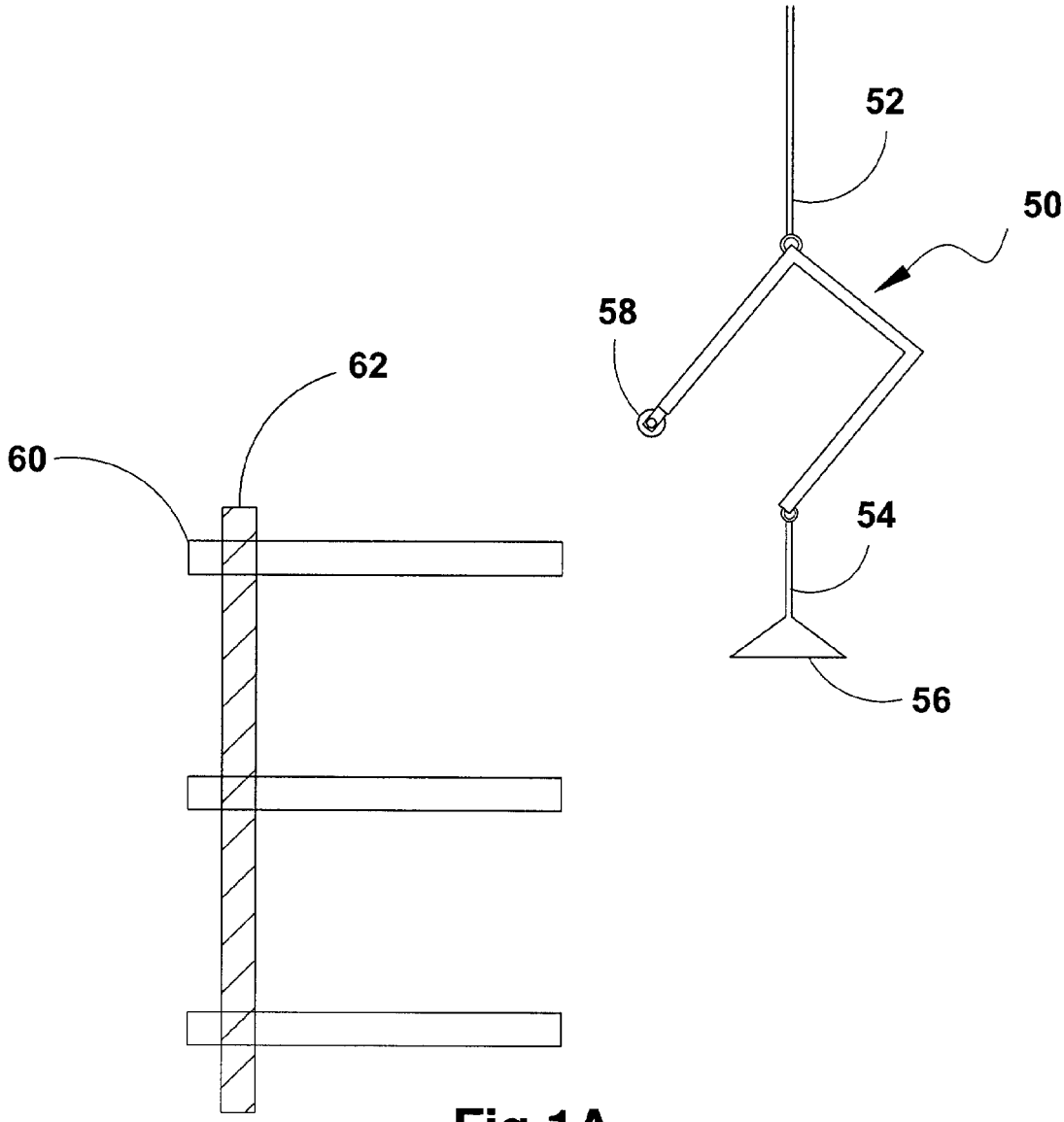
FIG. 1A is a schematic description of a suspended hoist of the present Invention.
Figure 1B:
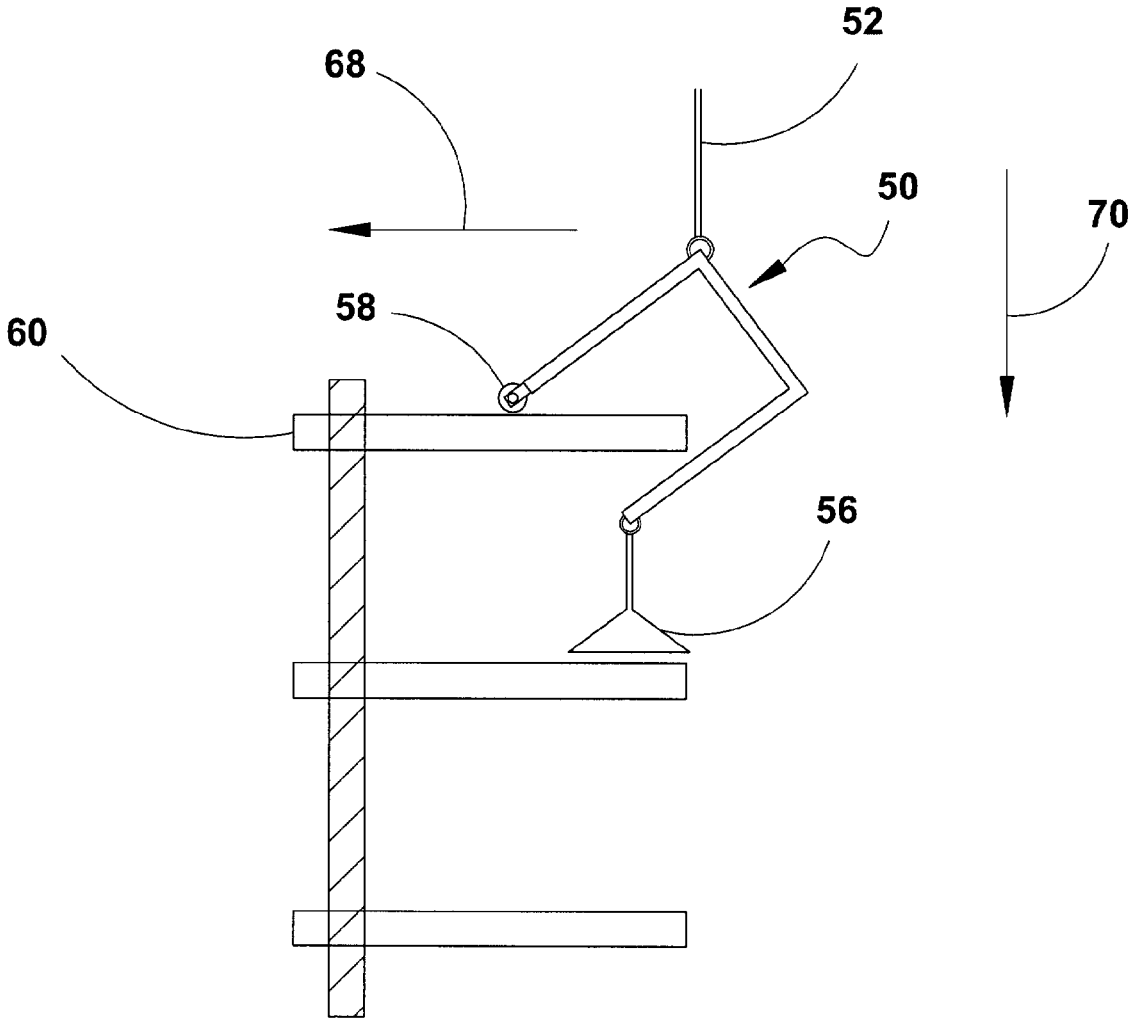
FIG. 1B is a schematic description of a suspended hoist of the present invention showing an insertion of the sliding wheel on a floor.
Figure 1C:
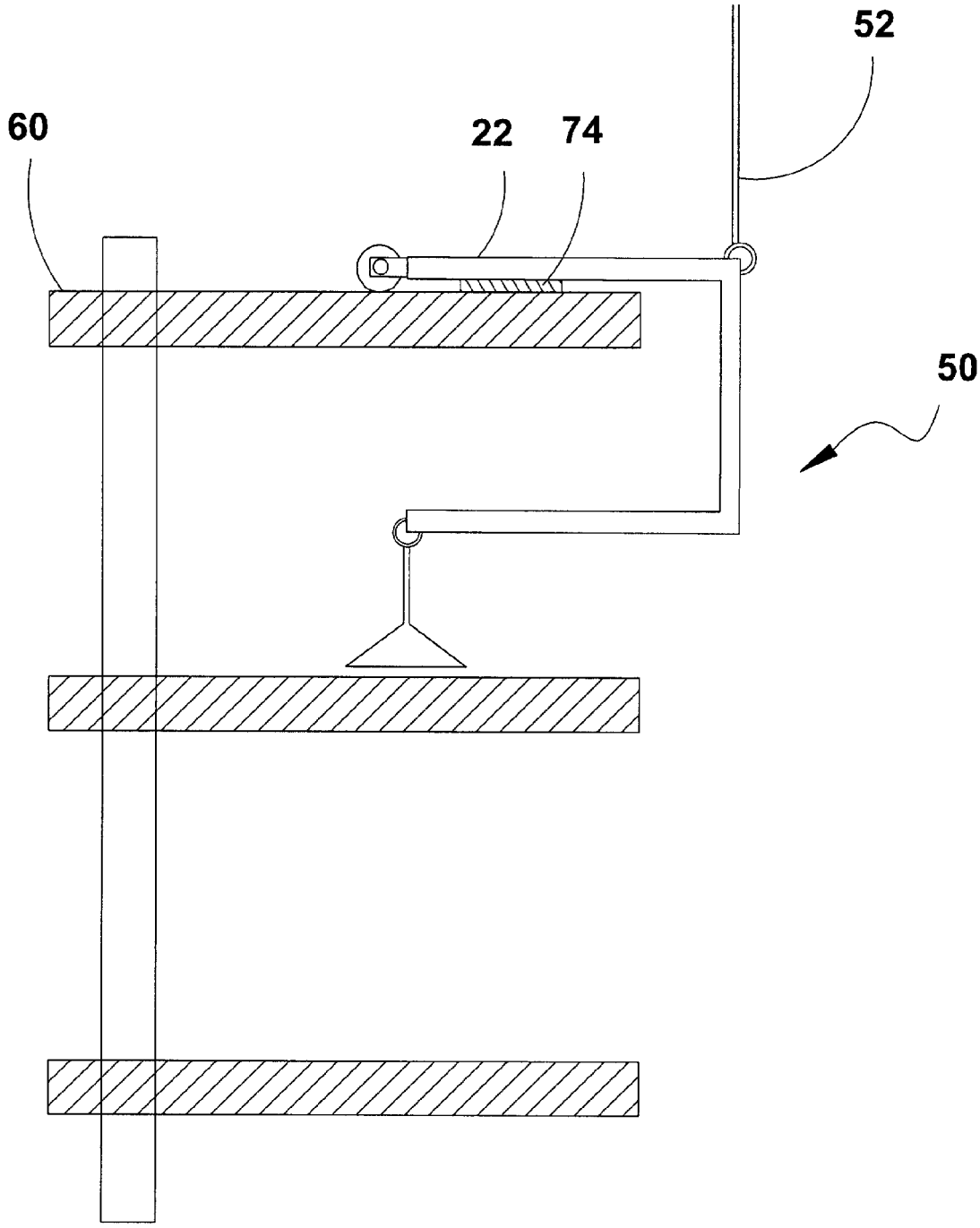
FIG. 1C is a schematic description of a suspended hoist of the present invention being lodged on a subtending floor.

A hoist in accordance with the present invention is a suspended "C" shaped construction or frame having two substantially parallel arms connected by a cross construction element. The hoist moves both sideways and vertically, directed by a crane. A hoist of the invention is a construction carrying a hook for material loading, and typically a wheel or a sled for sliding on the floor and a cable system for maneuvering the hoist and or controlling loading/unloading. Functionally, the hoist of the invention is applicable in construction sites in which floors are laid sequentially, leaving free access from the flanks. The function is explained in reference to FIGS. 1A-C. In FIG. 1A a hoist 50 is shown schematically, in a suspended position, hanging on cable 52 which is linked to a crane (not shown). Cable 54 carries a tray 56 with building material (not shown). Sliding wheel 58 disposed at the front end of the upper arm of the frame points towards floor 60. This floor and all other floors of the building are held by columns such as column 62. In FIG. 1B the hoist, suspended still on a crane cable, is pushed in the direction of arrow 68, advancing the hoist over the floor 60. Concomitantly, the hoist 50 is lowered in the direction of arrow 70, by the elongating cable 52, until sliding wheel 58 meets the upper surface of floor 60. As cable 52 is elongated still further, the entire hoist 50 rotates around sliding wheel 58, bringing the tray 56 further in the direction of arrows 68 and 70. In FIG. 1C hoist 50 is shown, after maneuvering has ended. Frame 22 of the hoist rests against a support 74. Cable 52 is no longer required to be tensioned, because the hoist rests firmly against the floor 60, through the mediation of support 74. Generally, however, such support may not be required if the frame of the hoist is made to rest directly against the supporting floor.

Figure 2A:
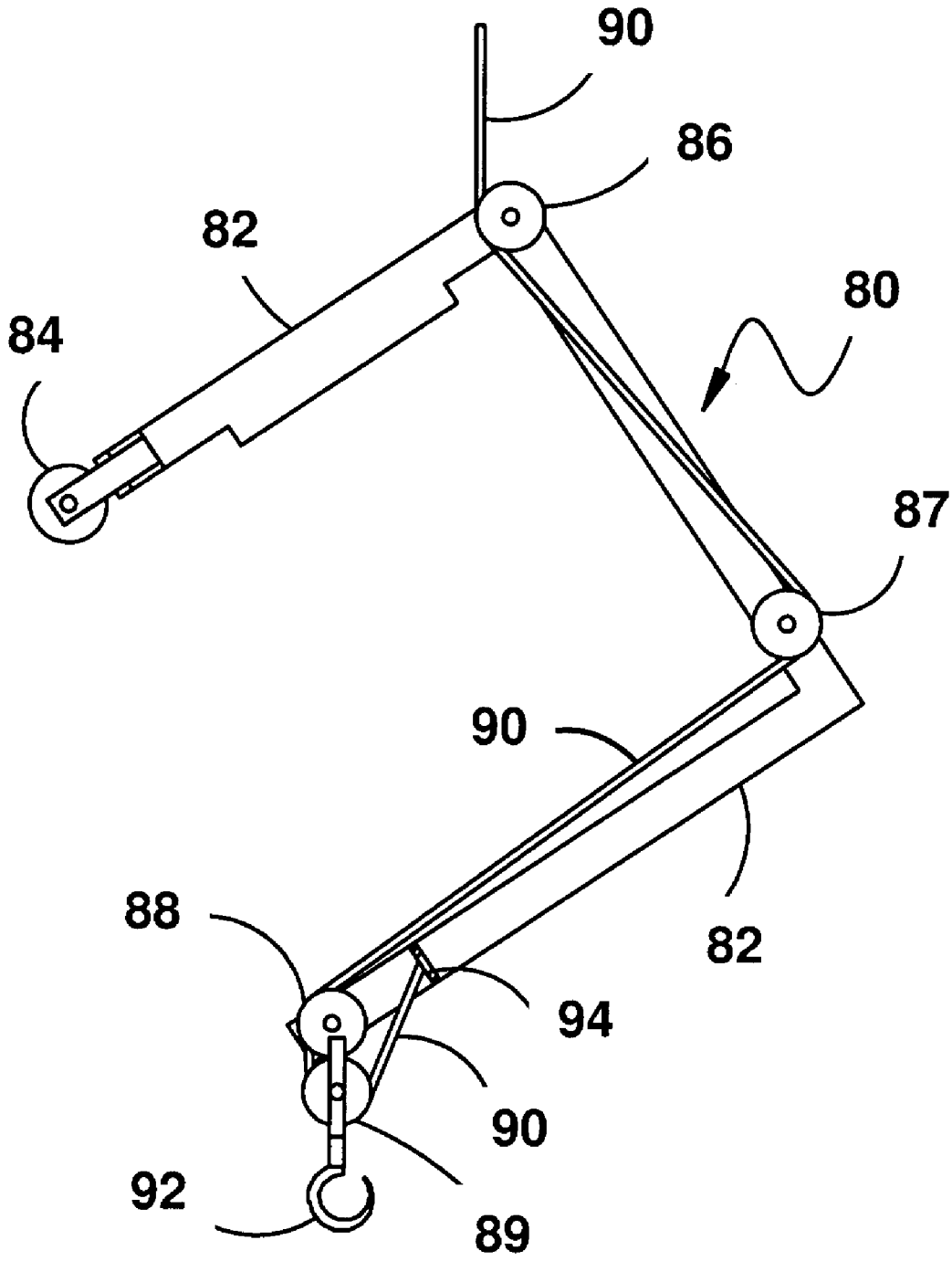
FIG. 2A is a schematic description of a preferred embodiment of a suspended hoist of the present invention showing pulley and cable assembly.
Figure 2B:
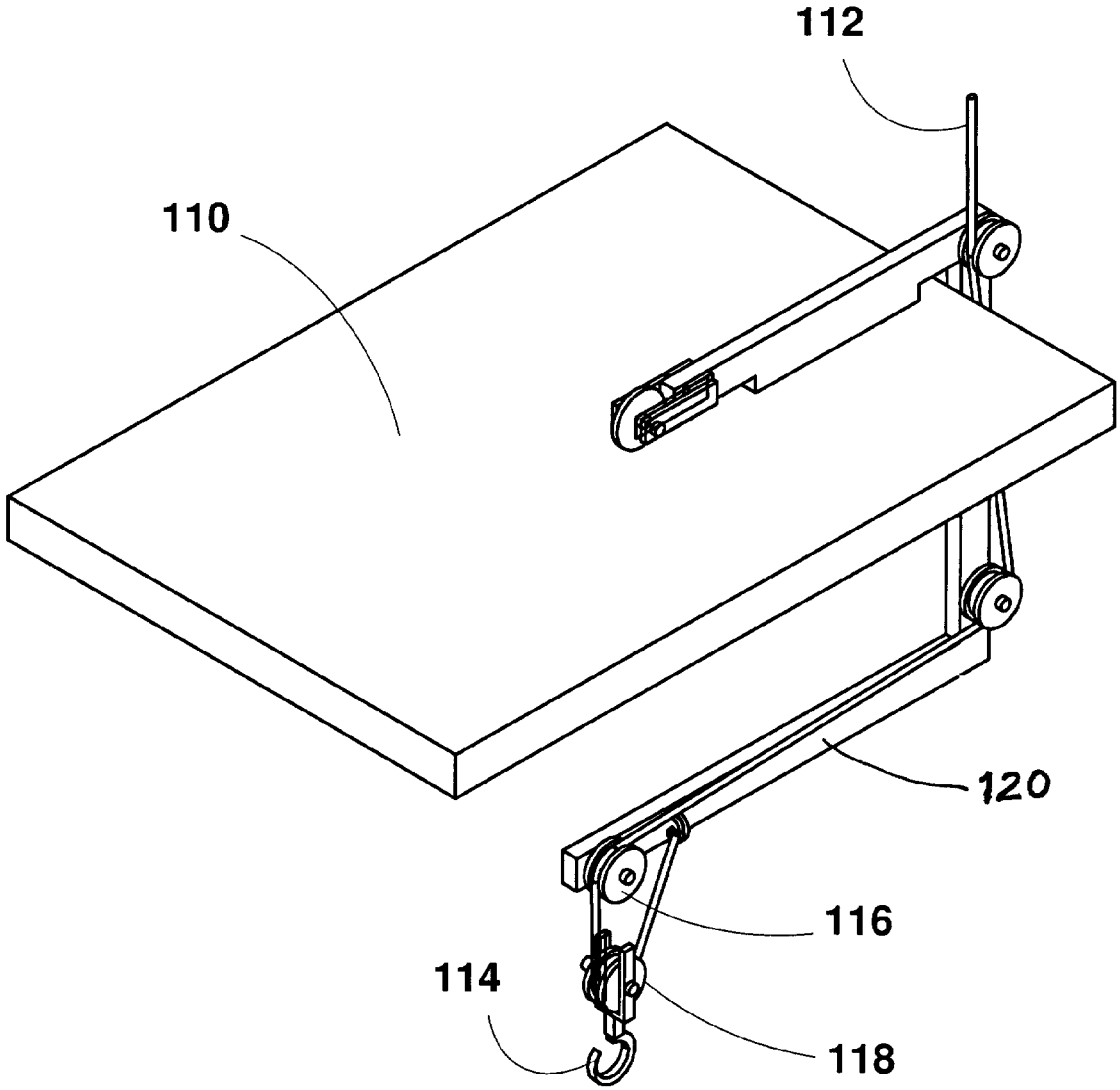
FIG. 2B is a schematic description of a suspended hoist of the present Invention being lodged on a subtending floor.

A preferred embodiment of the invention is demonstrated, structure and function, with reference to FIGS. 2A–B, which shows a structure of a hoist in accordance with a preferred embodiment of the invention. Hoist 80 contains a frame 82, a sliding wheel 84, a set of pulleys 86–89 that support cable 90, a hook 92, cable fastener 94 and a static frame support (not shown). In this figure, the hoist is shown suspended in the air typically carrying a tray of building material (not shown), by hooking on to hook 92. As can be seen, pulley 88 the pivot of which is connected to frame 82, is adjacent pulley 89 which has a free pivot only connected to hook 92. This adjacency is brought about by the tension of cable 90 which, at the top is anchored directly or indirectly to the crane, and at the bottom to fastener 94. The configuration of pulleys—cable assembly, is changed when the hoist is made to rest on top of a floor. This is shown schematically in FIG. 2B. Tile 110 represents the floor on which the hoist rests. Once the hoist is lodged on floor 110, cable 112 can be slackened without affecting the position of the hoist. However, such slackening translates into lowering of hook 114. As can be seen in the figure, pulleys 116 and 118 are departed since pulley 118 is not connected to frame 120, but rather to hook 114. Tensioning of lifting cable 112 results in hook 114 being drawn up, providing that the force applied is strong enough to lift up the hook and suspended material tray (not shown). Lifting up of the hook may occur until pulley 118 abuts on pulley 116. If the cable is tensioned further, the hoist may be lifted off the subtending floor providing that the tensioning force can overcome the suspended weight. If the load on the hook is heavier then a certain limit, the tensioning of the lifting cable may cause uplifting of the entire frame. In such cases, anchoring of the lodged frame to the subtending floor may be required.

Figure 3:
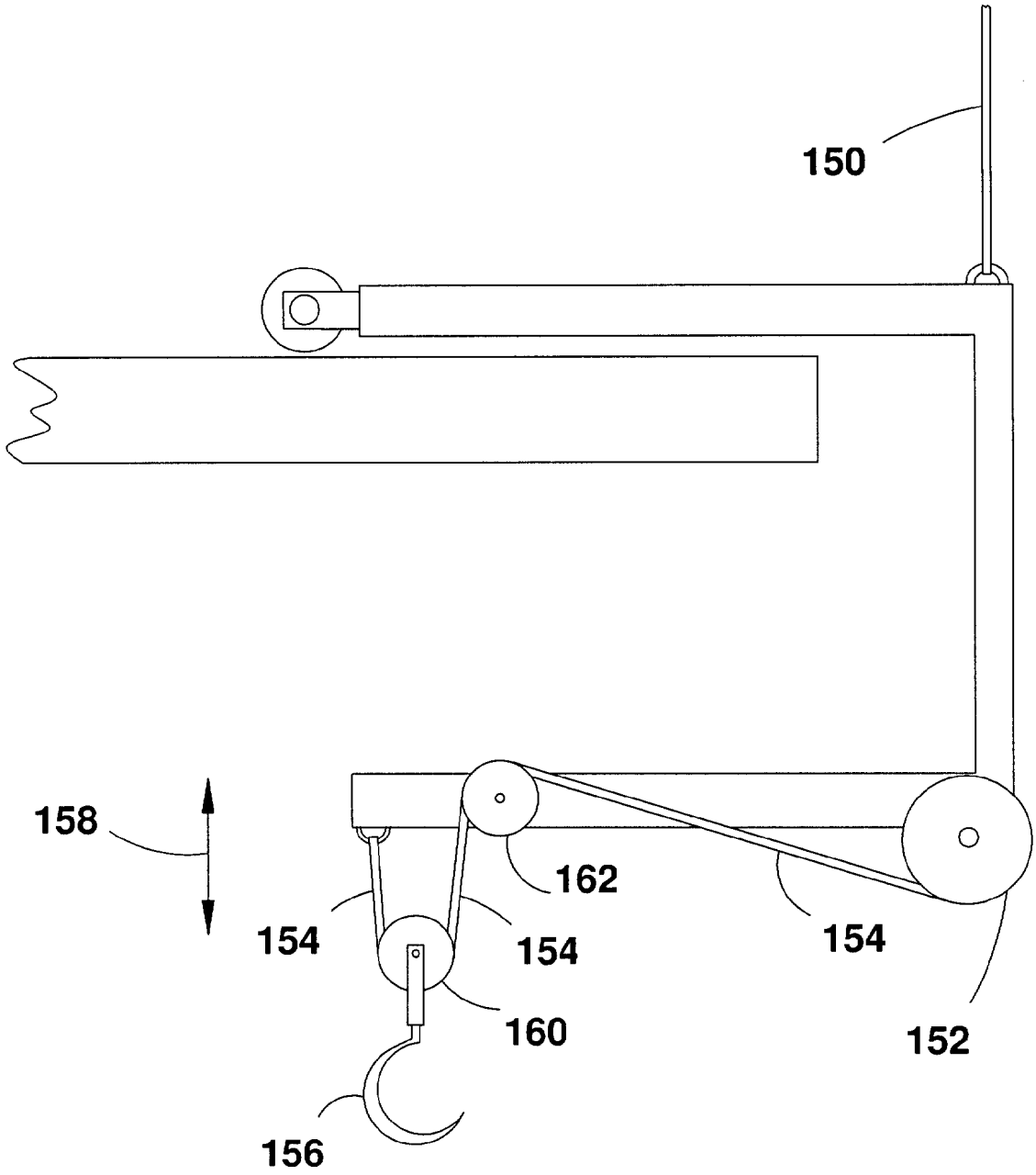
FIG. 3 is a schematic description of an embodiment of the invention in which the hook pulley is vertically translocatable suspended from a second pulley and an anchor point.
Figure 4:
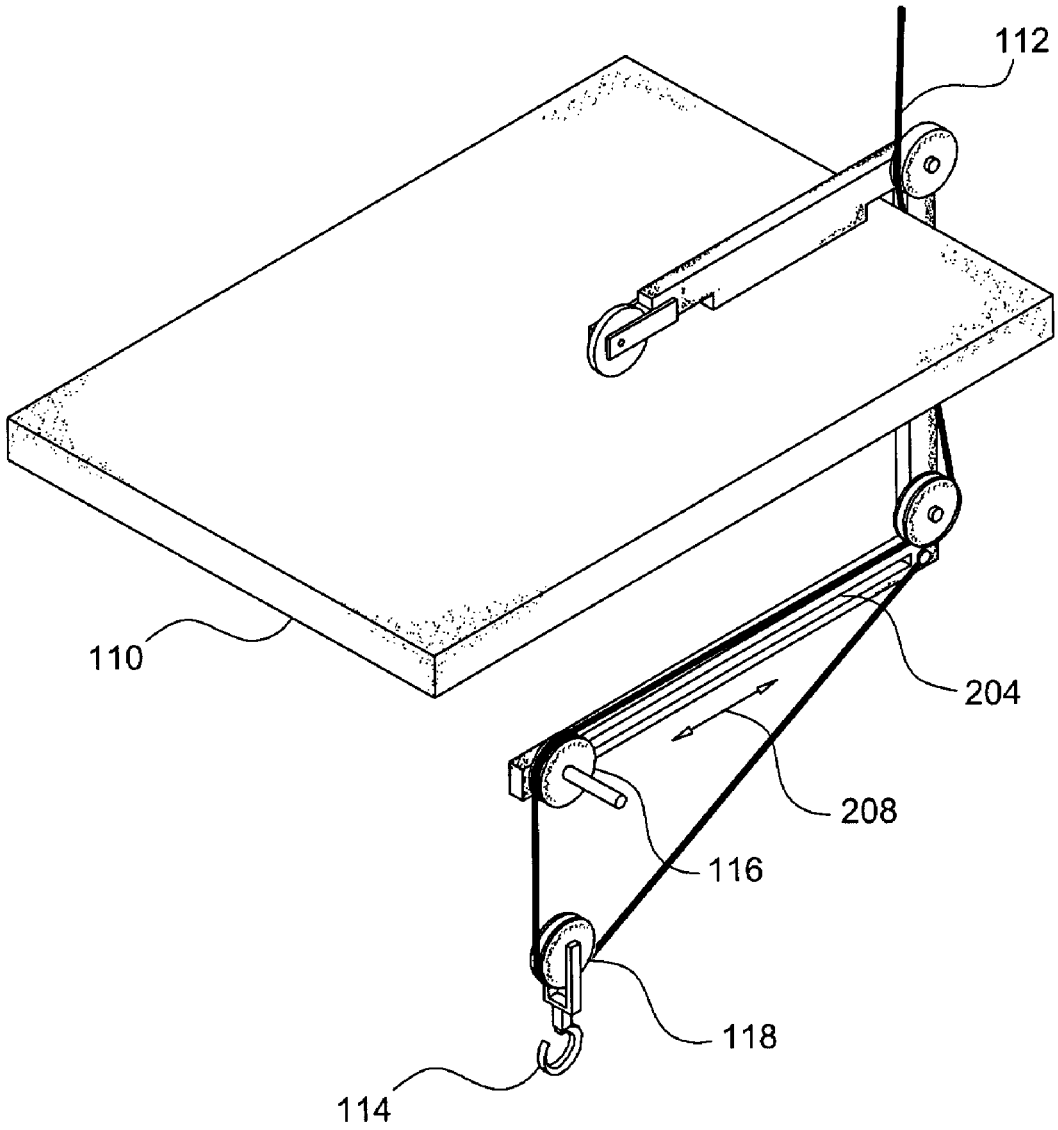
FIG. 4 is a perspective view of an embodiment of the invention in which the hook pulley is horizontally translocatable.

In another preferred embodiment of the present invention, an independent winch is located at the bottom arm of the frame of the hoist, providing a means for lifting/lowering the hook. This is explained with reference to FIG. 3. In this embodiment, the cable 150 suspended from the crane is tied statically to the hoist. Reel 152 is actuated by a motor (not shown) which winds cable 154 or releases it such that hook 156 moves up and down in the direction of arrow 158, as actuated by the operator controlling the motor. Cable 154 slides in the route as formed by the pulleys 160 and 162. In another constructional variation of the same embodiment, referring to FIG. 4, the lower arm of the hoist is used as a sliding rail track 204 for pulleys that carry the load along. A mechanical relocation facility along a horizontal direction 208 may be useful if precision placement of gear or material is required.

The invention claimed is:

1. A hoist for relocating at least building material, wherein said hoist is suspended from a crane, said hoist comprising:

a "C" shaped frame having two arms, one arm being an upper arm and the other arm being a lower arm;

a sliding means disposed at the front end of the upper arm of said frame for sliding said frame on a floor;

a hooking means comprising a hook connected to the lower arm of said frame for suspending a material tray on said frame;

a lifting cable for connecting the frame to a crane and for adjusting the distance of said hook from said frame when said frame is lodged on the floor.

2. A hoist for relocating at least building material as in claim 1, and wherein said sliding means is a wheel.

3. A hoist for relocating at least building material as in claim 1, and wherein said hooking means is at least vertically relocatable with respect to said frame.

4. A hoist for relocating at least building material as in claim 1, and wherein said hooking means is horizontally relocatable along the lower arm of said frame.

* * * * *